US005518064A

United States Patent [19]

Romanowski et al.

[11] Patent Number: 5,518,064

[45] Date of Patent: May 21, 1996

[54] THIN GAUGE ROLL CASTING METHOD

[75] Inventors: Christopher A. Romanowski, Lake Arrowhead; Apparao Duvvuri, Riverside, both of Calif.; William E. Carey, Nashville; William M. Marrison, McKenzie, both of Tenn.

[73] Assignees: Norandal, USA, Brentwood, Tenn.; Fata European Group S.r.l., Turin, Italy; Hunter Engineering Company, Inc., Riverside, Calif.

[21] Appl. No.: 242,778

[22] Filed: May 16, 1994

Related U.S. Application Data

[63] Continuation of Ser. No. 133,239, Oct. 7, 1993, abandoned.

[51] Int. Cl.[6] ..... B22D 11/06; B22D 11/16

[52] U.S. Cl. ..... 164/453; 164/452; 164/480

[58] Field of Search ..... 164/428, 480, 164/452, 453, 151, 154.8, 155.4

[56] References Cited

U.S. PATENT DOCUMENTS

| | | |
|---|---|---|
| 4,054,173 | 10/1977 | Hickam . |
| 4,497,360 | 2/1985 | Bercovici . |
| 4,526,223 | 7/1985 | Ai et al. . |
| 4,546,814 | 10/1985 | Shibuya et al. . |

(List continued on next page.)

FOREIGN PATENT DOCUMENTS

| | | | |
|---|---|---|---|
| 0194628 | 9/1986 | European Pat. Off. . | |
| 0228038 | 7/1987 | European Pat. Off. . | |
| 309394 | 8/1988 | European Pat. Off. . | |
| 0281815 | 9/1988 | European Pat. Off. . | |
| 0615801 | 9/1994 | European Pat. Off. . | |
| 60-83746 | 5/1985 | Japan | 164/428 |
| 63-104756 | 5/1988 | Japan | 164/428 |

OTHER PUBLICATIONS

"Roll Caster Applications and Developments" Frischknecht, et al., 1988.

"Continuous Casters for Aluninum Mini–Sheet Mills—An Alcoa Perspective" Bachowski, et al., *Casting of Near Net–Shaped Products,* The Metallurgical Society, 1988.

"The Development of a Second Generation Twin Roll Caster" Thomas, Davey McKee Limited Publication, 1989.

"An Experimental Study of Twin Roll Casting" Edmonds, et al., 1991.

"An Experimental Investigation of the Effect of Strip Thickness, Metallostatic Head and Tip Setback on the Productivity of a Twin–Roll Caster" Yun, et al., *Cast Metals,* vol. IV, No. 2, 1991.

"High Speed, Thin Strip Casting, The Transition from Laboratory Novelty to Commercial Reality" Thomas, et al., Abstract from the paper in The Minerals, Metals and Materials Society, 1992.

"High–Speed Thin Strip Caster" Davy International Publication, date unknown.

"Prospects of Thin Gauge High–Speed Strip Casting Technology" Espedal, et al., paper presented at The Minerals, Metals and Materials Society, 1993.

"Prospects of Thin Gauge High–Speed Strip Casting Technology" Espedal, et al., presentation at TMS Annual Meeting, 1993.

*Primary Examiner*—Kuang Y. Lin

*Attorney, Agent, or Firm*—Knobbe, Martens, Olson & Bear

[57] ABSTRACT

A method of operation of a twin roll casting apparatus to produce thin gauge sheet metal at high-production rates. The method includes simultaneously adjusting various operating parameters, such as the roll speed, tip position, roll gap, molten metal input temperature and exit strip tension. In an iterative fashion, the strip gauge is reduced in steps while increasing the speed of the rolls and pulling the tip back out of the roll bite. In conjunction with the aforementioned adjustments, the temperature of the molten metal input to the feed tip is gradually reduced to ensure proper solidification at higher speeds. A set of pinch rolls closes on the exit strip at a certain gauge thickness to apply a drag to the strip in order to ensure proper coil wind-up tension.

6 Claims, 4 Drawing Sheets

U.S. PATENT DOCUMENTS

| | | | |
|---|---|---|---|
| 4,577,672 | 3/1986 | Frischknecht et al. . | |
| 4,681,152 | 7/1987 | Flowers et al. . | |
| 4,702,300 | 10/1987 | Nakanori et al. | 164/154.8 |
| 4,751,958 | 7/1988 | Flowers et al. . | |
| 4,784,209 | 11/1988 | Hlinka et al. . | |
| 4,937,022 | 6/1990 | Dietrich et al. . | |
| 4,976,304 | 12/1990 | Buchner . | |
| 4,979,556 | 12/1990 | Braun et al. . | |
| 5,027,884 | 7/1991 | Ventavoli et al. . | |
| 5,031,688 | 7/1991 | Burgo et al. . | |
| 5,036,901 | 8/1991 | Williams et al. . | |
| 5,052,467 | 10/1991 | Tanaka et al. . | |
| 5,176,198 | 1/1993 | Frischknecht et al. . | |
| 5,191,927 | 3/1993 | Terado et al. . | |
| 5,303,765 | 5/1994 | Pearson et al. . | |

98
START
100
IS THERE CLEARANCE BETWEEN TIP AND ROLLS ?
NO
110
INCREASE SETBACK AND/OR RAISE TIP
YES
102
IS MACHINE AT MAX. SEPARATING FORCE?
YES
114
SHOULD INPUT METAL TEMP. BE REDUCED ?
YES
116
REDUCE TEMP.
NO
NO
112
INCREASE SPEED
104
DESIRED GAUGE ?
NO
118
SHOULD PINCH ROLLS BE CLOSED ?
YES
120
CLOSE PINCH ROLLS
YES
NO
108
REDUCE GAUGE
106
STOP

THIN GAUGE ROLL CASTING METHOD

This application is a continuation of application Ser. No. 08/133,239, filed Oct. 7, 1993, now abandoned.

FIELD OF THE INVENTION

The present invention relates to casting of thin sheets of metal and, more particularly, to a method for casting thin gauge sheet metal in a twin roll casting apparatus.

BACKGROUND OF THE INVENTION

Twin roll casting can be set apart from other continuous casting processes in that it is a combined solidification/deformation technique. All of the major competitive processes, such as continuous mold casting, are solidification only, whereafter the cast product is subjected to independent downstream deformation operations. In contrast, twin roll casting involves feeding molten metal into the bite between a pair of counter-rotating cooled rolls wherein solidification is initiated when the metal contacts the rolls. Solidification prior to the roll nip, or point of minimum clearance between the rolls, causes the metal to be deformed, or hot rolled, prior to exiting the rolls as a solidified sheet. The hot rolling operation produces good surface quality, and the rapid solidification due to good thermal contact between the metal and the cooled rolls leads to a very fine grain size, which is preferred for certain applications such as computer hard disks.

There have been numerous patents issued and a large amount of research done on twin roll casting technology. Two early patents showing a twin roll casting apparatus are U.S. Pat. Nos. 3,817,317 to Gilmore and 4,054,173 to Hickam. Although twin roll casting eliminates one or more steps associated with traditional methods, as shown in FIG. 8 of "Continuous Casters for Aluminum Mini-Sheet Mills—An Alcoa Perspective" (1988), twin roll casting has suffered from productivity limitations in comparison. The productivity limits have not been addressed adequately in the prior art, although some solutions have been offered based on experimental work.

In general, the trend has been to produce thinner gauge sheet in the twin roll casting apparatus, which can be rolled at higher speeds due to faster overall strip solidification. Others have conducted studies investigating the effect of strip thickness on the productivity of twin roll casters. Due to problems associated with starting a twin roll caster at thin gauges, it has been determined that the machine must begin casting at relatively thick gauges and the gauge thickness progressively reduced. The gauge thickness is reduced by decreasing the spacing between the rolls, which is typically accomplished by raising the bottom roll. As the rolls are brought closer together, and the strip gauges are reduced, the speed of the rolls can be increased.

Some increase in productivity has apparently been achieved during these experiments. However, the experimental strip widths have typically been limited to 150 mm, or about 6 inches, and reported at speeds only up to 10 m/min, or 15 m/min maximum. In contrast, commercial twin roll casting operations may include strip widths close to 100 inches and may run at much greater line speeds. To date, it is believed that no one has been able to scale up and integrate these promising results in laboratory settings to a larger commercial twin roll casting apparatus in an actual casting line. For example, one of the big problems with casting extremely thin sheet has been the inability to ensure extremely close tolerances of the roll crowns. While a slight deviation from a desired roll crown may be acceptable for casting 6 mm thick strip, the same deviation may be totally unacceptable when casting 1 mm thin strip. And it has proven extremely difficult to ensure a precise roll crown tolerance for actual production-sized rolls.

Therefore, there exists a need for increased productivity in twin roll casting machines and, specifically, a need to solve the problems associated with converting experimental results into a practical commercial unit.

SUMMARY OF THE INVENTION

The present invention provides a practical framework within which to operate a slightly modified twin roll casting apparatus to produce high-quality thin gauge strip metal at high production speeds. In accordance with one aspect, the invention comprises adjusting various operating parameters of a twin roll casting apparatus in order to control the location of the solidification "freeze front" or "freeze plane" of the molten metal within the roll bite. Generally speaking, as the roll gap is reduced, the separating force generated by the solidifying metal between the rolls increases. The amount of separating force is affected by the location of the freeze front in relation to the roll nip, or central plane through the roll axes. As the roll gap is reduced, the percentage reduction of the metal sheet is increased, and thus the separating force goes up. At some point, a hydraulic system used to position the lower roll cannot overcome the separating force, and the minimum gauge thickness has been reached for these particular operating parameters. In order to reduce the separating force and allow the rolls to be brought closer together, the present invention comprises the adjustment of at least three operating parameters alone or in conjunction. These operating parameters are: the speed of the rolls, the temperature of the molten metal fed between the rolls, and the position or "setback" of the feed tip relative to the roll nip.

The twin roll casting apparatus of the present invention comprises a furnace and holding chamber connected to a launder trough, a preheater, a degasser, a filter, and a head box and tip assembly adjacent the twin rolls. The tip assembly includes two plate-like refractory tip halves having a gap therebetween positioned directly between the rolls to introduce molten metal into the roll bite. Horizontal and vertical adjustment of the tip position is accomplished with brushless DC motors. Each caster roll is driven by an independent electric motor through an epicyclic gear reducer. Each roll is provided with a unique internal cooling system, which maximizes cooling uniformity around the circumference and along the width of each roll. The roll spacing is held constant by a hydraulic system comprising a pair of hydraulic load cylinders located under the lower roll bearing blocks actuated by hydraulic servo-valves. The gap between the twin rolls is determined by measuring the cylinder positions with internal position transducers. Separating force between the rolls is monitored by analog hydraulic pressure gauges in communication with the fluid supply line of each load cylinder. The temperature of the inlet molten metal, position of the feed tip, roll gap, separation force and other parameters are constantly monitored and controlled by an industrial control system.

In order to cast thin gauge strip, the twin roll casting apparatus is started up at a large roll gap for which a steady-state condition is relatively easy to attain. Once a steady-state condition is reached, the roll gap, and associated strip gauge, is reduced in steps, each new operating condition preferably being allowed to reach a steady state. To begin with, the roll gap is reduced until either the separating force limit is reached or further movement of the lower roll will contact the feed tip. If the feed tip is in the way, and the separating force limit has not been reached, the tip is moved up and away from the roll gap a specified increment, and the roll gap is reduced slightly further. Moving the tip farther out of the roll bite also increases the separating force. This procedure continues with the roll gap being reduced and the tip being repositioned alternately until the separating force for that particular roll gap at a particular speed has been reached.

The speed of the rolls is then increased in order to move the freeze front forward or downstream towards the roll nip, thus decreasing the separating force. After a steady-state condition has been reached, the iterative procedure of reducing the roll gap and repositioning the tip is continued until the separating force limit is reached once again, at which time the speed is reduced further. Eventually, the preferred casting gauge or minimum gauge possible (currently approximately 1 mm) is reached, at which point any further changes are halted and the caster allowed to cast sheet at high speeds.

Because of the extremely high speeds of the rolls for thin gauge casting conditions, the tensile strength of the cast sheet exiting the rolls is significantly compromised. This is due to the fact that as the speed of the rolls is increased, the freeze front gradually moves forward toward the roll nip and, notwithstanding the adjustment of the tip setback, eventually moves forward far enough so that the high exit temperature of the strip results in a reduced tensile strength. A minimum amount of tension must be applied to the strip so that the metal will progress through the roll nip at a required operating pace.

The present invention incorporates a preheater prior to the molten metal head box, which is used to adjust the inlet temperature (and thus affect the outlet temperature) of the molten metal. Prior to the preheater, the melt furnace or holding chamber is set to a relatively low temperature at which the molten metal still flows. At the start-up of the gauge reduction cycle, when the rolls are moving the slowest, the preheater is actuated to raise the temperature of the molten metal to allow optimum positioning of the freeze front at the slow roll speeds. In other words, if the molten metal were too cool, the freeze front would develop too soon and the separating force generated would be quite high, and even excessive. Later on in the gauge reduction cycle, the preheater is gradually switched off to reduce the temperature of the molten metal to a value which allows the freeze front at the final casting speed to be sufficiently upstream of the roll nip so that the tensile strength of the exit strip is at or above a predetermined level.

Despite the inclusion of the preheater, which helps ensure the tensile strength of the exit strip will be high enough to provide good, continuous strip feedthrough at the increased casting speeds the tensile strength of the thin exit strip will be insufficient to provide a resistance tension for the coil wind-up reel. The final coil must typically be tightly wrapped to prevent inner wrap movement and to facilitate further processing in a cold mill. Consequently, after the strip gauge is reduced to the point it can no longer support sufficient winder tension to obtain a tightly wrapped coil, a pinch roll assembly between the twin roll casting apparatus and the winder is hydraulically closed to resist the winder tension applied to the strip, while maintaining correct operating tension at the caster roll nip. The pinch rolls are initially used when the strip is being first fed through the casting line and are released when the winder applies tension to the strip, only to be brought back into play at higher casting speeds to effectively apply a "drag" to the cast strip.

DESCRIPTION OF THE PREFERRED EMBODIMENTS

It will be understood that the principles of the present invention relating to a method for reducing the gauge of cast strip are not limited to the particular twin roll caster described herein, but can be applied with equal success to twin roll casters of varying configurations.

Casting Line

Figure 1:
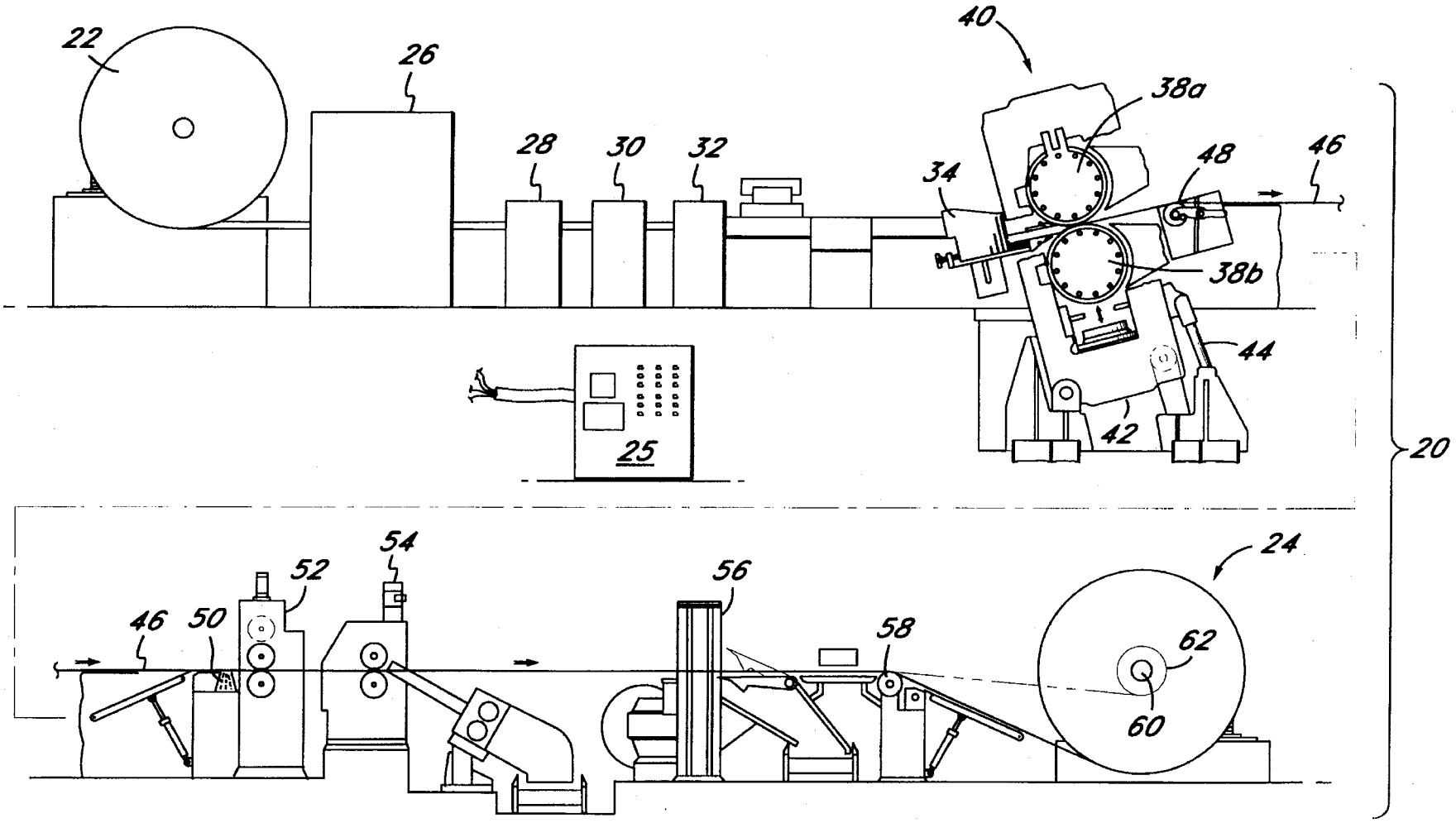
FIG. 1 is a side elevational view of an entire twin roll casting line of the present invention.

Referring to FIG. 1, a twin roll casting line 20 is shown, which begins at a furnace 22 on an upstream end and terminates in a coil winder 24 on the downstream end. Raw materials melt within the furnace 22 and pour into a holding chamber 26 which maintains the molten metal at a preferred temperature. The twin roll casting line 20 of the present invention is particularly suited for casting various aluminum alloys; however, the inventive concepts embodied herein are not considered to be limited to only aluminum alloys. After the holding chamber 26, molten aluminum of a constant composition and at a constant temperature and level passes through a degasser 28, a filter 30 and a preheater 32 before being introduced into a "head box" 34 just prior to a twin roll caster 40. The casting operations along the line 20 are preferably monitored and controlled by an industrial control system 25 shown schematically at 25. In accordance with the inventive steps discribed herein, cast strip gauge reduction can be facilitated in a commercial casting line and productivities of at least 3.7 metric tons per meter strip width per hour realized.

The head box 34 is connected to a planar pouring nozzle or feed tip 36, which distributes the metal between twin rolls 38 of the caster 40, the width of the tip determining the width of the cast strip. The twin roll caster 40 generally comprises the aforementioned rolls 38, which are pivotably mounted and supported on bearings fixed within a large, sturdy frame 42. Each caster roll 38 is driven by an independent electric motor through an epicyclic gear reducer (not shown). The entire frame 42 may be tilted with the use of hydraulic cylinders 44. The 15-degree tilt of the twin roll caster 40 allows regulation of the nozzle exit pressure by control of the head box level, permitting smooth flow of the metal from the feed tip 36 to the internally water cooled rolls 38*a,b*.

The molten metal is cast in a bite 37 between the rolls 38 and the resulting solidified strip 46 moves over an internally-cooled guide-out roll 48, past a strip air cooler 50 and between a set of pinch rolls 52. At start-up, the pinch rolls 52 are hydraulically closed over the forward end of the strip and tension applied to the strip to maintain correct operating conditions at the nip of the twin rolls 38. The strip then passes through an edge trimmer 54, a shear 56, over a break-over roll 58, and to a mandrel 60 where it is wound onto a core 62 into a coil. When the maximum coil diameter has been reached, a coil car platen (not shown) with rollers removes the coil. The shear 56 parts the strip 46 and continuously scrap cuts the leading edge of the strip during the coil change sequence. Once the tail of the old coil is wound up, the mandrel collapses, and both rewind reel and coil car traverse simultaneously away from the center line strip 46 in opposite directions. When both machines have traversed out, a belt wrapper (not shown), which has been preloaded with a core 62, positions the core at the centerline of the strip. The rewind reel then traverses to the core, the mandrel expands and the shear 56 stops cutting. The leading edge of the strip 46 is guided by tables into the belt wrapper, which winds the coil around the core. After a few wraps, line tension is established by the winder 24, and the belt wrapper opens the jaw and traverses back to its "out" position.

Twin Roll Caster

Figure 2A:
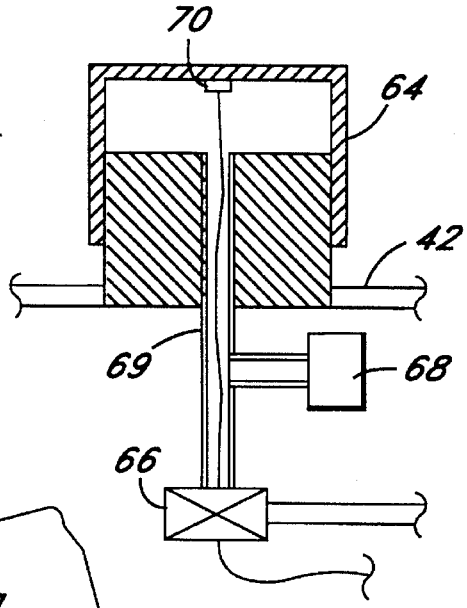
FIG. 2*a* is a detailed schematic view of a load cylinder hydraulic system and internal monitoring sensors.
Figure 2:
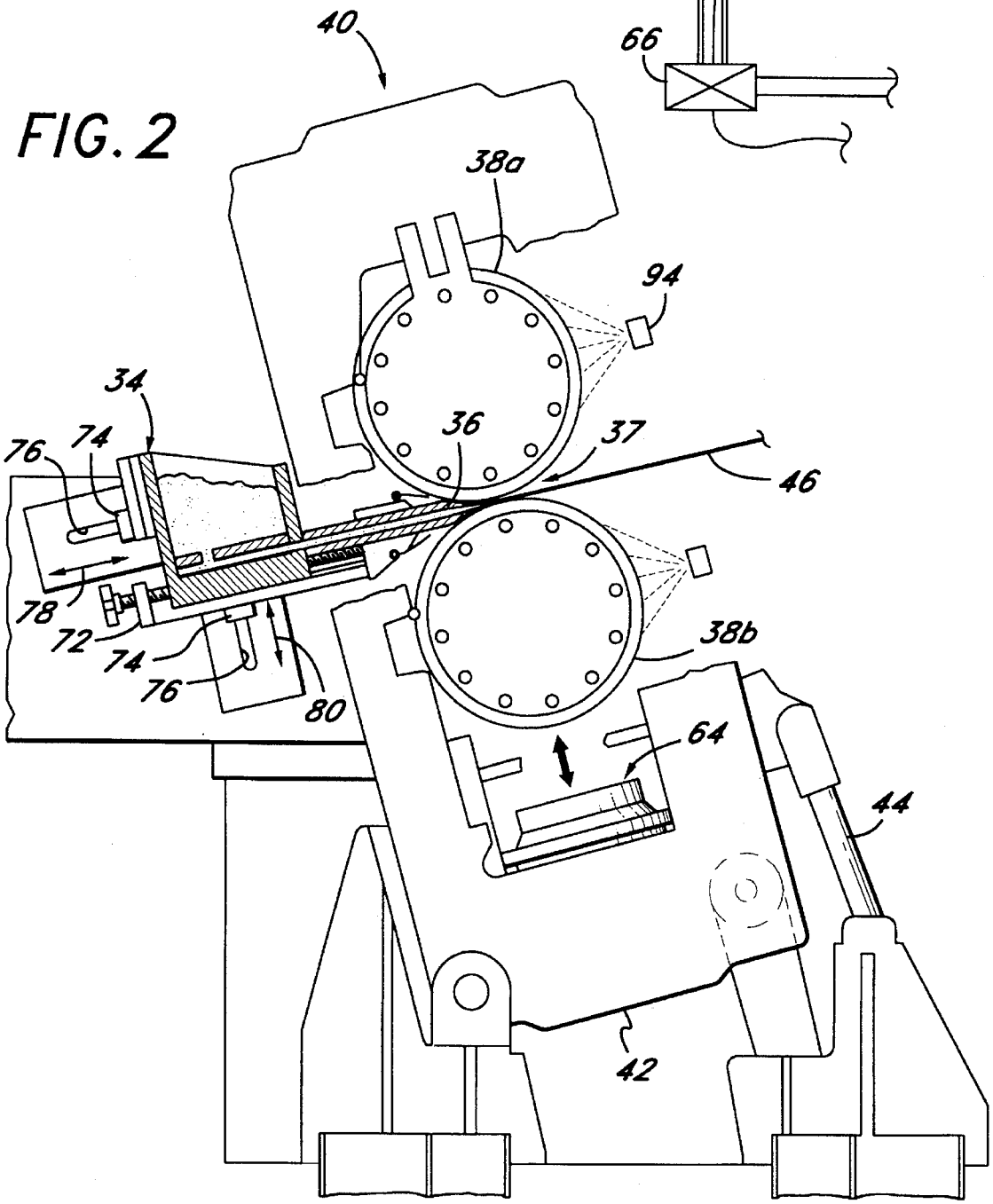
FIG. 2 is a side elevational view of the twin roll casting apparatus and surrounding components.

As best seen in FIG. 2, the twin roll caster 40 generally comprises the two independently driven horizontal rolls, an upper roll 38*a* and a lower roll 38*b*, which are internally water cooled and positioned one above the other in the frame 42 at a 15-degree tilt. The caster frame 42 consists of two heavy cast steel housings cross-tied for rigidity. The frame 42 assembly is mounted for tilt-back casting position during operation with hydraulic cylinder pivot actuation to a vertical position for roll change. The rolls 38 consist of forged steel cores with stainless steel overlays and forged alloy steel shells. The caster roll shell is cooled by contact with water flowing in machined circumferential grooves in the surface of the core. Such internally cooled rolls are well-known in the art. Unlike previous attempts, the highly adaptable roll profile afforded by this preferred roll cooling system enables the setting of the roll profile to close tolerances, which is mandatory for casting at extremely thin gauges.

Roll Gap Control

The upper roll 38*a* is in a fixed position relative to the frame 42 while the lower roll 38*b* may be adjusted toward or away from the upper roll with a pair of large hydraulic load cylinders, one of which is shown generally at 64. As seen in FIG. 2*a*, each hydraulic load cylinder 64 is actuated by a hydraulic servo-valve 66 and a pressure transducer 68 is placed in fluid communication with a supply line 69 therebetween. The load cylinders 64 are located under the lower roll bearing blocks and are controlled by electronic input to the servo-valves 66. A linear position transducer 70, such as a magnetostrictive sensor, placed within each load cylinder accurately monitors the position of the cylinders which can be converted into the roll gap distance. The rolls 38 may be actuated by other devices, such as wedge blocks, and their relative position and separating force determined by other means as well.

The gap control system controls both hydraulic load cylinders 64, balancing the separating forces on the caster rolls 38 and maintaining a constant preset roll gap or a constant pressure within the cylinders. The magnetostrictive sensor type linear position transducer 70 centrally located in each cylinder 64 provides position feedback. The pressure transducer 68 in each servo-valve 66 line provides accurate monitoring of the caster roll separating conditions. Both sets of feedback signals to the central industrial control system 25 are used to provide closed-loop control. The caster rolls 38 are initially "zeroed" by means of an automatic zeroing function in which the rolls are brought together and a preset pressure threshold applied. Measurements from the load cylinder position transducers 70 are then stored and used to achieve accurate gap control. The roll gap is initially set by the operator and the electro-hydraulic system maintains it constant, providing compensation for stretch in the caster housings.

Two selectable modes of operation are available. During start-up and initial gauge reduction, a constant gap mode is required. When operating at thin gauges, bumpless transfer to a constant pressure mode is provided. In the constant gap mode, the linear position transducers 70 within the hydraulic load cylinders 64 provide feedback to the control system 25, which regulates the amount of hydraulic fluid metered into the cylinders through the servo-valves 66 in order to maintain the gap at a constant distance. This mode of operation is suitable for the larger strip gauges, as eccentricities of one or both of the rolls 38 are not an overriding concern as far as the gauge tolerance of the final cast sheet. However, as the gauge is reduced, the eccentricity in the rolls 38 makes a relatively bigger impact on the tolerances of the final cast sheet. Thus, for thinner gauges, the roll caster apparatus 40 switches to a constant pressure mode allowing the lower roll 38*b* to move slightly toward or away from the upper roll 38*a*, depending on the pressure sensed by the pressure transducers 68. To illustrate this mode of operation, if a bulge or eccentricity in one of the rolls 38 enters the roll bite 37, the pressure sensed by the pressure transducers 68 will increase and will be communicated to the control system 25, which adjusts the lower roll 38*b* away from the upper roll 38*a* to reduce the pressure.

Ideally, the sensing and feedback loop between the linear position transducers 70, pressure transducers 68, servo-valves 66 and control system 25 is a continuous process. However, practical considerations limit the feedback loop to a series of continuous frequent samples, preferably a multiple of samples per second. A preferred control system 25 suitable for managing the gauge reduction cycle of the twin roll caster 40 is provided by Reliance Electric under the trade name Automax. This system generally comprises a plurality of 32-bit processors, provided with a distributed power system and Power Module Interface Racks (PMI).

Feed Tip Adjustment

In the feed tip assembly, the ceramic fiber tip 36 is supported by a metal tip holder, and the tip assembly is supported in the caster 40 by a tip table 72. A quick changing device is provided to lock the tip holder to the table 72. The tip table 72 comprises a fabricated steel table mounted on a machined steel carriage plate. The table 72 is positioned by a pair of brushless DC servo-motors, shown schematically at 76, which provide individual adjustments on each side of the tip 36 as required during operation. The tip table 72 is mounted to the caster frame 42 by a brushless DC motor positioned slide. Horizontal and vertical adjustment and positioning by the brushless DC motors 76, as indicated by arrows 78 and 80, respectively, are accomplished and monitored under directions from the control system 25.

Figure 3:
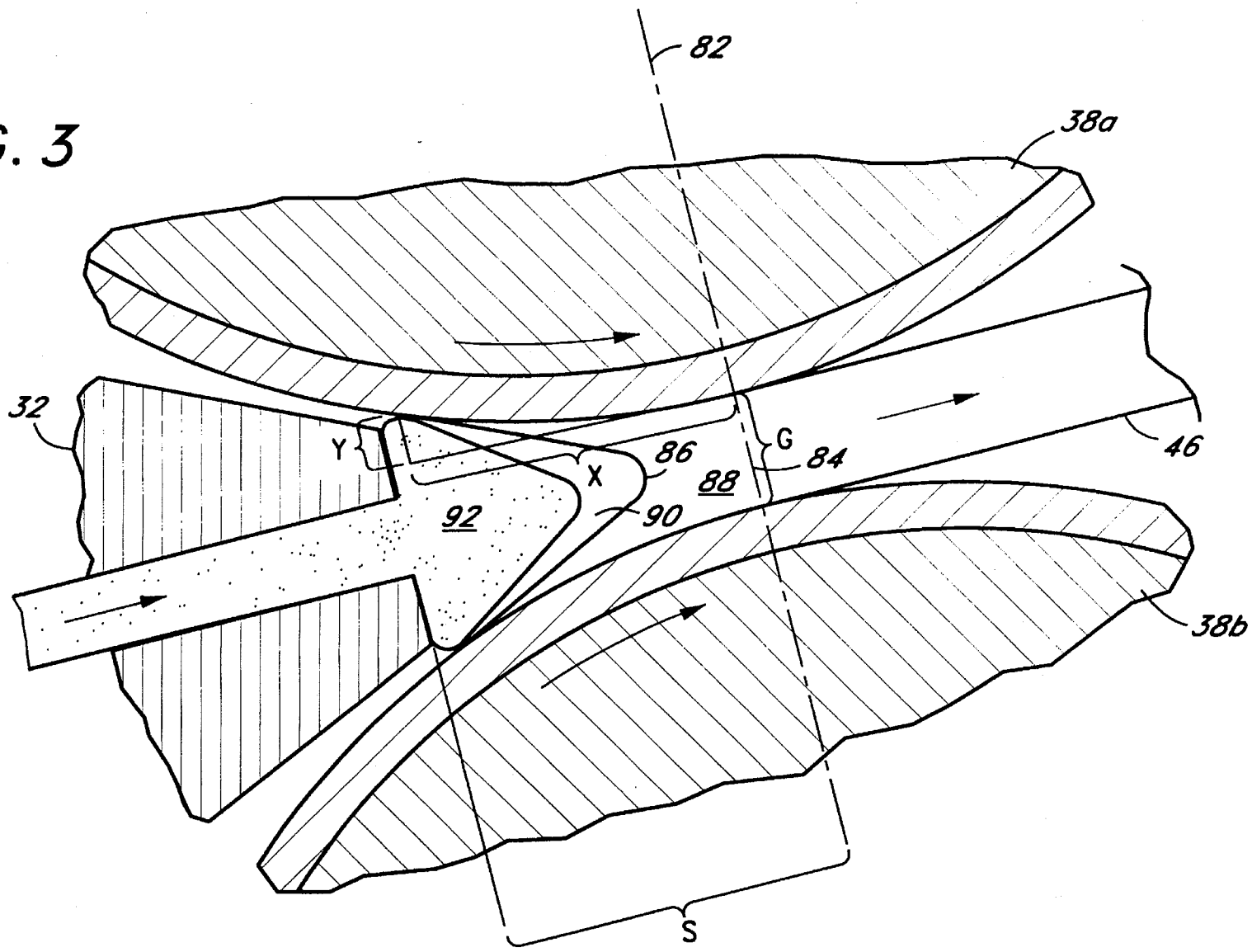
FIG. 3 is a detailed view of the roll bite showing the relative position of the feed tip and the solid-liquid phase interfaces.

During the process for reducing the gauge of the cast strip 46, the lower roll 38*b* is brought closer to the upper roll 38*a* via the hydraulic load cylinders 64. As seen in FIG. 3, there is only a very small clearance between the feed tip 36 and the rolls 38, and this clearance must be maintained as the lower roll is moved. Thus it becomes necessary to reposition the feed tip 36, both in the horizontal and in the vertical planes as the gap is adjusted. The servo-motors 76 are used to adjust the setback and working height of the tip 36 at each side. Reference signals are derived from software "look-up" tables. The movement of the feed tip 36 is precisely controlled by the industrial control system 25. Prior to a casting operation, the relative position of the feed tip 36 and the caster rolls 38 is determined or calibrated. Subsequently, any movement of the feed tip 36 apparatus or the lower roll 38*b* is monitored and combined with a precise knowledge of the geometry of these structures to allow the control system 25 to calculate when the lower roll is in close proximity with the feed tip 36. Prior to a collision, a movement of the feed tip 36 is initiated. The operator is provided with a display of the feed tip position at the control system 25.

Roll Casting Mechanism

Referring now to FIGS. 2 and 3, the exit of the feed tip 36 is slightly ahead of the centerline of the rolls 38. This distance, indicated by S, is usually referred to as the "setback." The plane 82 through the centerline of the rolls 38 passes through an area of minimum clearance between the rolls 38 referred to as the roll nip 84 which spans the distance G. A consequence of the setback S is that the molten metal solidifies at a thickness dimension in excess of the roll nip 84, the rolls 38 then deforming the metal to the final strip thickness at 46. Thus, solidification and hot rolling of the aluminum is accomplished in one step. The process results in a strip 46 with precise dimensions, good surface appearance and a high quality, "hot worked," internal structure. This combination of solidification and hot rolling generates a substantial roll separating force. As mentioned above, the separating force between the rolls 38 is sensed by pressure transducers 68 within the load cylinders 64 which communicate with the industrial control system 25.

With specific reference to FIG. 3, a solidification region exists between the solid phase 88 and liquid phase 92, and includes the mixed liquid-solid phase region 90. For discussion purposes, a "freeze front" 86 at the line of complete solidification is defined. As can be seen in the drawing, the freeze front 86 begins at the top and bottom of the metal flow adjacent a point on the internally cooled rolls 38 and extends forward in the direction of the metal flow due to the increasing temperature throughout the metal cross-section. A triangle may be drawn with "the run" (represented by X) extending from a point on the upper roll 38*a* at the roll nip 84 directly upstream to a perpendicular line continuing to the intersection of the freeze front 86 with the surface of the upper roll. The "rise" of the triangle is given as Y. This triangle represents the change in thickness of the solid phase of metal from the point of solidification to the point of hot rolling at the roll nip 84.

It can be readily seen that the maximum percent reduction of solid metal can be approximated by the equation $100\times(G/(G+2Y))$. This diagram illustrates that at a set roll gap G, as the distance X becomes smaller, or as the freeze front 86 approaches the roll nip 84, the percent reduction will be reduced, thus reducing the associated separating force. Conversely, if the distance X remains the same, but the distance G between the rolls 38 is decreased, the percent reduction increases, thus increasing the separating force.

In the former case, speeding up the rotating rolls 38 moves the freeze front 86 further downstream or towards the roll nip 84 and decreases the separating force, while in the latter case, bringing the rolls closer together reduces the gauge of the cast strip 46 and increases the separating force on the rolls.

Many factors affect the position of the freeze front 86 between the rotating rolls 38. Some of the most important factors are the temperature of the metal exiting the feed tip 36, the particular metal or alloy type, the speed of the rotating rolls 38, the metallostatic head of the molten metal head box 34, the heat transfer coefficient of the shell of the roll, the thickness of the shell, and the rate of internal cooling of the rolls. In order to predict certain operating conditions to facilitate the gauge reduction cycle, a two-dimensional heat transfer mathematical model has been formulated. This model assumes uniformity across the width of the cast strip and utilizes a forward finite difference technique to predict the temperature distribution within the caster roll shells and also the cast strip exit temperatures. Several unknown parameters of the casting process are estimated and the semi-empirical heat transfer model runs on an IBM-PC with run times of less than five minutes. A detailed discussion of this mathematical model is given in *Aluminum Cast House Technology*, a publication stemming from a symposium staged at the Department of Chemical Engineering, University of Melbourne, Australia, on Jul. 4–8, 1993. The article is entitled "The Influence of Casting Gauge on the Hunter Roll Casting Process", pp. 333–347, P. Vangala, et al. As will be discussed in more detail below, the predictions based on this mathematical model may be used by the industrial control system 25 to plan a sequence of steps for reducing the gauge of the cast strip 46.

Parting Spray

Another parameter critical to high-speed casting is the application of proper type and amount of parting agent between the roll surface and the solidifying metal strip 46. At high speeds, a 5–6% solution of colloidal graphite with trace additions of proprietary agents is sprayed on the roll surfaces at quantities up to 10 times greater than the normal casting processes. The spray volume is controlled by the position of a metering needle at each nozzle 94.

Pinch Rolls

The pinch rolls 52 are used for strip 46 threading during start-up and coil changes. Also, the pinch rolls 52 provide the tension differential between the roll nip 84 and the winder 24 during thin gauge casting. Specifically, after the strip gauge is reduced to the point where it is no longer able to support winder tension to obtain a tightly wrapped coil, the pinch rolls 52 are hydraulically closed to maintain correct operating conditions at the roll nip 84 while maintaining the proper windup tension at the winder 24. The pinch rolls 52 are carried in anti-friction-type cartridge bearings. The bottom roll is fixedly mounted, and the top roll is raised and lowered by hydraulic cylinders. The top roll movement is equalized by a rack-and-pinion arrangement, and both rolls are water cooled.

Process Iteration During Gauge Reduction Cycle

Figure 4:
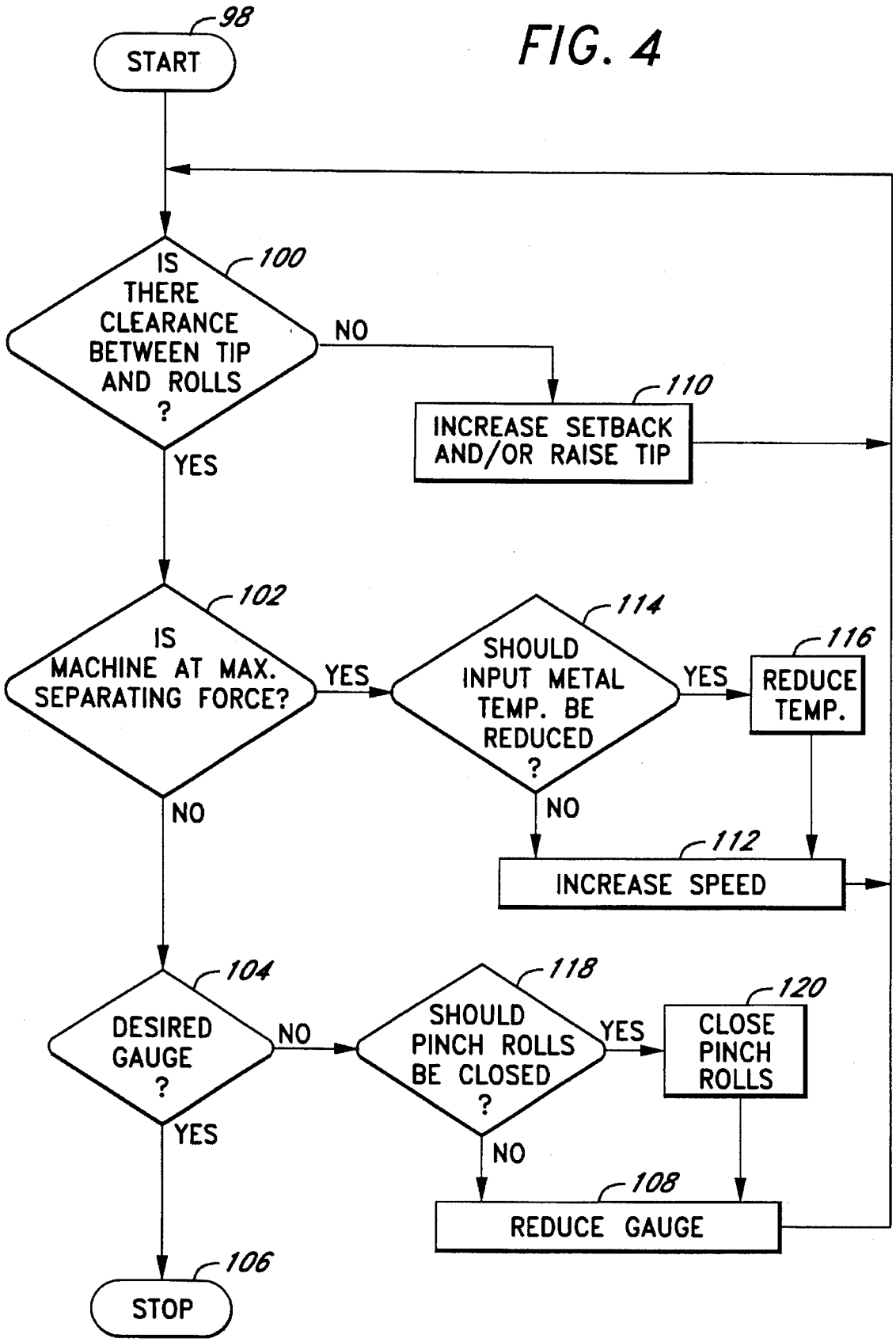
FIG. 4 is a flowchart showing a gauge reduction procedure.

FIG. 4 illustrates a preferred sequence of events during gauge reduction using the twin roll caster 40 of the present invention. The events are monitored and initiated by the industrial control system 25 based on sensed input data from the various sensors and transducers in and around the casting line 20. The control system may comprise, for example, a central operator's station having signals, switches, pushbuttons, gauges, etc., and, as mentioned previously, a computer system such as a Reliance Electric Automax with a color CRT display for running and-or maintaining the entire casting line 20 automatically.

Initially, at action block 98, roll casting is initiated at a relatively large gauge, such as 6 to 10 millimeters, and the operating conditions allowed to attain a steady state. In decision block 100, the control system determines whether there is clearance between the feed tip 36 and the rolls 38. If there is clearance, the control system 25 determines whether the twin roll caster 40 has reached maximum roll separating force in decision block 102. (It is noted that it is not necessary to set this iteration at maximum separation force, but setting this value at a smaller value will increase the total number of iterations required.) If the twin roll caster 40 is below the maximum separating force, leading to a "no" result from decision block 102, the control system 25 determines whether the desired strip gauge has been reached in decision block 104. As mentioned previously, the roll gap is monitored from within the load cylinders 64 by position transducers 70 which indicate the strip thickness at the roll nip 84. However, the final strip thickness may be somewhat different than the roll nip distance and can be sensed by downstream proximity centers (not shown) which also provide feedback to the control system 25. One or both of these strip gauge sensors may be used to determine whether the desired gauge has been reached. If the correct thin gauge has been attained (a "yes" result), the caster 40 will continue to run while the logic loop shown in FIG. 4 will be terminated, as indicated in action block 106. After the desired gauge is reached, the casting line 20 may run for days, even weeks, until either strip width change, alloy change, scheduled roll maintenance or other major operational changes.

Before the above-described final sequence of events occurs, the strip gauge must be reduced from its initial value to a desired thickness, such as 1 millimeter. The gauge reduction occurs in action block 108 after the control system 25 has determined there is clearance between the tip 36 and rolls 38 in action block 100 and that the caster 40 is operating below the maximum separating force limit in decision block 102. If there is clearance, and if the caster 40 is operating below the maximum separating force, after determining whether the pinch rolls 52 should be closed, the lower roll **38*b* of the caster is raised up to reduce the gauge thickness of the strip 46, as indicated in action block 108. The gauge is only reduced a small amount or step before the logic returns to decision block 100 to check whether there is clearance between the feed tip 36 and the rolls 38 again. Also, if there is clearance, the control system 25 again checks whether the maximum separating force has been reached in decision block 102. At this point, if the desired gauge has not been reached, as determined in decision block 104, the gauge is reduced a further step in action block 108. This sequence of events will continue until one of the three decision outcomes in blocks 100, 102 or 104** changes.

For example, if it is determined in decision block 100 that there is no longer clearance between the feed tip 36 and the rolls 38, a no result will initiate an action indicated in block 110 which increases the setback and/or raises the height of the tip. The control system 25 then loops back to the top at decision block 100 to check the clearance. Of course, the clearance has now been adjusted to allow the control system to check whether the maximum roll separating force has been reached in decision block 102. After passing the separating force test, the control system first determines whether the input metal temperature should be reduced and then determines whether the desired gauge has been reached and reduces the gauge if not. This subloop of the overall logic loop will continue with the gauge being reduced and the feed tip position being adjusted in-between gauge reductions if necessary until the caster 40 reaches the maximum separating force.

When the maximum separating force has been reached, as determined in decision block 102, the control system 25, after cheking whether the molten metal inlet temperature should be adjusted, increases the roll speed as indicated in action block 112. As was previously mentioned, increasing the roll speed causes the freeze front 86 to move toward the roll nip 84 or downstream, as best seen in FIG. 3. This movement of the freeze front 86 decreases the ratio between the thickness of the strip at the initial point of solidification and the thickness at the roll nip 84, thus decreasing the roll separating force as proportionally less solidified metal is being compressed and hot rolled. Therefore, the next iterative loop will pass decision block 100 and decision block 102 and the desired gauge will be checked again in decision block 104. The process continues with the gauge being reduced and/or the feed tip 36 being repositioned until the twin roll caster 40 reaches the maximum separating force again, as determined in decision block 102. At this point, the roll speed is again increased a small amount as in action block 112.

Now referring again to FIG. 3, it can be seen that at a given position of the freeze front 86, a proportionally greater amount of metal is solidified and then hot rolled at thinner gauges. This is due to the fact that for a given freeze front position, the same thickness of metal is being compressed while the overall thickness of the strip is lower for thinner gauges. Consequently, the gauge may be reduced a greater amount for thicker strips before the maximum roll separating force is reached and the roll speed increased. In other words, the control system 25 actuates a greater number of gauge reduction steps at first, the number of steps between roll speed changes getting smaller and smaller for thinner gauges. As an illustrative example, one might roll a 6 millimeter strip 46 and reduce the thickness down to 3 millimeters before a roll speed change is needed. After that, the gauge might be reduced down to 2 millimeters before another roll speed change is necessary. The gauge reduction steps continue to get smaller and smaller down to an anticipated target gauge thickness of 1 millimeter.

Although the above description of the main portion of FIG. 4 represents the preferred sequence of events, it has been found that it is difficult if not impossible to position the freeze front 86 optimally in the roll bite 37 during a gauge reduction cycle for a constant molten metal input temperature. More particularly, at slow roll speeds and initially large gauge strip 46, the molten metal must be maintained at a first predetermined elevated temperature above its melting point in order to ensure that the freeze front 86 is sufficiently forward within the roll bite 37 to prevent premature cooling and solidification which might create an excessive roll separating force. However, if this elevated molten metal temperature is maintained throughout the gauge reduction cycle, eventually the roll speed will be great enough that the freeze front 86 cannot be maintained at an optimum location regardless of tip setback S. If the freeze front 86 is allowed to progress forward into the roll nip 84, the cast metal will not be hot rolled and, worse perhaps, the exiting strip 46 will not have a sufficient tensile strength to withstand the pulling force of either the winder 24 or the intermediate pinch rolls 52. For instance, one suitable metal, Aluminum 1100 alloy, experiences a drastic reduction in tensile strength at temperatures above 550° F.

In order to avoid this situation, the temperature of the molten metal in the furnace 22 or holding chamber 26 is set to a second predetermined value which is lower than the first predetermined temperature needed at the slowest speeds during startup. The preheater 32, as seen in FIG. 1, is then utilized to bring the temperature of the molten metal up from the second predetermined level toward the first predetermined level. As the gauge reduction cycle progresses, the preheater 32 is gradually stepped down and finally turned off to gradually reduce the temperature of the molten metal input through the feed tip 36 into the roll bite 37. Although less efficient, it is possible to maintain the temperature of the molten metal at the first predetermined level and provide supplemental cooling rather than preheating to reduce the temperature to the second temperature.

Although the preheater 32 is shown as an independent device, it may be eliminated and instead incorporated into either the degasser 28 or filter 30. One example of a degasser having an internal heater is the Snif Sheer R-10 system manufactured by Snif Aluminum Refining of Tarrytown, N.Y. Suitable ceramic tube filters having internal heaters for use in the present invention are manufactured by TKR Corporation of Japan, for example. These devices are designed to thermally prime the caster process start-up to compensate for the premature chilling effect of cold refractory components such as the feed tip 36. However, these devices are not needed and the heaters turned off after the refractory elements attain an elevated temperature.

The reduction of the input molten metal temperature is shown in action block 116 in FIG. 4 and is initiated after decision block 114 which occurs after a check of the separating force. The position of this decision block 114 prior to the step 112 of increasing the speed prevents any disastrous speed increase at an elevated temperature which might compromise the tensile strength of the exit strip 46 causing a rupture downstream of the twin rolls 38.

The timing and extent of this temperature reduction is preferably determined by an accurate knowledge of the temperature distribution in the roll bite 37 at the various operating conditions. The two-dimensional mathematical model previously mentioned has proven sufficient to predict the temperature distribution in the roll bite 37 and most importantly, the exit temperature of the rolled strip 46 for these purposes. Preferably, a preferred timing sequence for reducing molten metal temperature has been worked out prior to a roll casting operation and thus the control system need only adjust the molten metal inlet temperature based on a lookup table. Of course, the particular timing sequence for reducing the molten metal temperature will depend on various factors which change between casting operations such as the type of metal being cast and other considerations. Likewise, conditions during a casting run may influence the timing sequence for reducing the molten metal temperature; these factors include but are not limited to the temperature of the cooled twin rolls 38, the speed of rotation of the rolls and the setback of the feed tip 36. In one embodiment, the mathematical model is used to generate a series of lookup tables for various operating conditions during the casting run, the industrial control system 25 thus being spared time-consuming processing during a run.

FIG. 4 also illustrates a decision loop which determines whether the downstream pinch rolls 52 need to be activated in order to apply a drag to the exit strip 46. As explained previously, as the gauge becomes thinner at the roll nip 84, it no longer is able to resist the tensile force applied by the coil winder 24. At a certain gauge thickness, therefore, the downstream pinch rolls 52 are activated to close on the exit strip 46 and maintain the tension with the coil winder 24 while keeping the tension level at the roll nip 84 to a level sufficient for operating conditions but not exceeding the tensile strength of the strip at this location. Of course, once the exit strip 46 has passed over the internally cooled guide-out roll 48, the tensile strength is increased to a level which may at least withstand the force of the pinch rolls 52, if not the winder 24. However, at the roll nip 84, the temperature of the exit strip 46 is elevated to a level which compromises its tensile strength thus requiring this pinch roll operation.

Thus, after a check as to whether the desired gauge has been reached in decision block 104, decision block 118 determines whether the pinch roll should be closed based on the gauge thickness as monitored by the aforementioned sensors and either a direct sensing or a projected estimate of the strip exit temperature. These parameters will enable the control system 25 to determine whether the tensile strength of the exit strip 46 at the roll nip 84 is reduced to a point where rupture of the strip is eminent. At this point, a yes result from decision block 118 initiates a closure of the pinch rolls 52 in action block 120. Following either a yes or a no result from decision block 118, the strip gauge is reduced further. The timing of the pinch roll decision block 118 prior to the step 108 of reducing the gauge thus eliminates the possibility that the gauge can be reduced below a point which the exit strip 46 tensile strength may be insufficient to withstand the pulling force of the coil winder 24. Instead, the pinch rolls 52 are first closed and then the gauge reduced further.

Although this invention has been described in terms of certain preferred embodiments, other embodiments that are apparent to those of ordinary skill in the art are also within the range of this invention. Accordingly, the scope of the invention is intended to be defined only by reference to the following claims.

We claim:

1. A method for roll casting sheet metal, comprising the steps of:

(a) setting a gap between a pair of twin rolls to a first distance and turning the rolls at a first speed;

(b) feeding molten metal from a feed tip into a roll bite between the rolls, the metal being at a first temperature;

(c) reducing the roll gap by causing one or both of the rolls to move toward the other until a first pre-determined separating force occurs between the rolls;

(d) increasing the rotational speed of the rolls, upon the occurrence of said first pre-determined separating force, to reduce the separating force applied by the solidifying metal between the rolls; and (e) repeating steps (b) through (d) until a desired roll gap is achieved.

2. The method of claim 1, comprising the step of adjusting the temperature of the molten metal input to the feed tip after initial warm-up procedures.

3. The method of claim 2, comprising the steps of:

maintaining a supply of molten metal at a second predetermined temperature; and raising the temperature of the molten metal prior to the feed tip to a first predetermined temperature, and said step of adjusting comprises reducing the first predetermined temperature downward toward the second predetermined temperature.

4. The method of claim 1, comprising the steps of:

applying a wind-up tension to the cast strip on an exit side of the twin rolls;

reducing the tension on the exit strip to a value below the wind-up tension during the reduction of strip gauge in order to prevent rupture of the strip at this point.

5. The method of claim 1, further comprising the step of sensing the occurrence of said first pre-determined separating force between said rolls.

6. The method of claim 5, further comprising the steps of:

determining the position of the feed tip; and adjusting the position of the feed tip relative to the rotating rolls to avoid contact therebetween.

* * * * *

UNITED STATES PATENT AND TRADEMARK OFFICE

CERTIFICATE OF CORRECTION

PATENT NO. : 5,518,064

DATED : May 21, 1996

INVENTOR(S) : Romanowski, et al

It is certified that error appears in the above-indentified patent and that said Letters Patent is hereby corrected as shown below:

Column 3, line 20, change "reduced" to -- increased --.

Signed and Sealed this

Twenty-fourth Day of June, 1997

Bruce Lehman

*Attest:*

BRUCE LEHMAN

*Attesting Officer*

*Commissioner of Patents and Trademarks*